US010780484B2

(12) United States Patent
Wen et al.

(10) Patent No.: US 10,780,484 B2
(45) Date of Patent: Sep. 22, 2020

(54) PROCESSING METHOD AND APPARATUS FOR METAL HOUSING

(71) Applicant: SHENZHEN TATFOOK QUAINTFAB CO., LTD., Shenzhen, Guangdong Province (CN)

(72) Inventors: Jie Wen, Shenzhen (CN); Zijian He, Shenzhen (CN)

(73) Assignee: SHENZHEN TATFOOK QUAINTFAB CO., LTD., Shenzhen, Guangdong Province (CN)

( * ) Notice: Subject to any disclaimer, the term of this patent is extended or adjusted under 35 U.S.C. 154(b) by 545 days.

(21) Appl. No.: 15/541,364

(22) PCT Filed: Dec. 31, 2014

(86) PCT No.: PCT/CN2014/095861

§ 371 (c)(1),
(2) Date: Jun. 30, 2017

(87) PCT Pub. No.: WO2016/106666

PCT Pub. Date: Jul. 7, 2016

(65) Prior Publication Data

US 2017/0348750 A1 Dec. 7, 2017

(51) Int. Cl.

| | |
|---|---|
| ***B21D 19/02*** | (2006.01) |
| ***B21D 19/08*** | (2006.01) |
| ***H01R 43/18*** | (2006.01) |

(52) U.S. Cl.
CPC ..... *B21D 19/088* (2013.01); *B21D 19/02* (2013.01); *H01R 43/18* (2013.01)

(58) Field of Classification Search
CPC ..... B21D 19/00; B21D 19/02; B21D 19/08; B21D 19/10; B21D 19/12; B21D 51/10;
(Continued)

(56) References Cited

U.S. PATENT DOCUMENTS 2,480,011 A * 8/1949 Freter ..... B21C 37/29 72/325
3,759,203 A * 9/1973 Frankenberg ..... B21D 1/08 72/370.05

(Continued)

FOREIGN PATENT DOCUMENTS

CN 2731780 Y 10/2005
CN 101499593 A 8/2009

(Continued)

OTHER PUBLICATIONS

Jixun Wang, Lei Wang, "Design of Multi-Position Progressive Die for a Shell of USB", Die & Mould of Forging Equipment and Manufacturing Technology, Feb. 2011, pp. 84-86, Issue 2, China Academic Journal Electronic Published House, China.

*Primary Examiner* — Edward T Tolan
(74) *Attorney, Agent, or Firm* — Cheng-Ju Chiang

(57) ABSTRACT

A processing method and a processing apparatus for a metal housing are provided. The method includes: sleeving a metal flat pipe having an end face provided with a curved surface portion on a lower mold; and pressing the curved surface portion by the cooperation between an upper mold and the lower mold, thereby forming a chamfered slanted surface on the curved surface portion. The processing processes and the apparatus involved are simple, the quality of the products is improved, and thus the method may be suitable for mass production.

18 Claims, 13 Drawing Sheets

(58) Field of Classification Search
CPC .... B21D 51/14; B21D 51/2638; B21D 51/36; B21D 19/088; B21C 37/155; H01R 43/18
See application file for complete search history.

(56) References Cited

U.S. PATENT DOCUMENTS 4,621,421 A * 11/1986 O'Loughlin ..... H01R 43/16 29/874
5,177,991 A * 1/1993 Sansoucy ..... B21J 9/20 72/355.6
5,333,485 A * 8/1994 Ublacker ..... B21D 41/045 72/341
5,678,444 A * 10/1997 Nagamori ..... B21D 22/206 72/333
6,666,734 B2 * 12/2003 Fukatsu ..... H01R 13/055 29/33 M
7,530,251 B2 5/2009 Takada et al.
8,179,670 B2 * 5/2012 Huang ..... B21D 31/02 361/679.02
8,240,185 B2 * 8/2012 Jin ..... B21D 19/08 29/429
2005/0136223 A1 6/2005 Hoguchi
2011/0089682 A1 * 4/2011 Bauer ..... B21D 41/021 285/189
2013/0305803 A1 * 11/2013 Wiget ..... B21D 41/00 72/370.1
2017/0348756 A1 * 12/2017 Wen ..... H01R 13/50

FOREIGN PATENT DOCUMENTS

CN 201338050 Y 11/2009
CN 201868721 U 6/2011
JP S59-127931 A 7/1984
JP 2001-179549 A 7/2001
JP 2009-99420 A 5/2009

* cited by examiner

PROCESSING METHOD AND APPARATUS FOR METAL HOUSING

CROSS REFERENCE TO RELATED APPLICATIONS

The present application is a 35 U.S.C. § 371 National Phase conversion of International (PCT) Patent Application No. PCT/CN2014/095861, filed on Dec. 31, 2014, the disclosure of which is incorporated by reference herein. The PCT International Patent Application was filed and published in Chinese.

TECHNICAL FIELD

Embodiments of the present disclosure generally relate to metal housing processing technology, and in particular relate to a processing method and a processing apparatus for a metal housing.

BACKGROUND

In the prior art, an end face of a metal housing of a data interface normally needs to be chamfered in order to enhance a strength of the end face. In general, the end face of the metal housing having a hole is chamfered using CNC (Computer numerical control). However, for a metal housing having a smaller dimension, it is difficult to reposition the cutter when using the CNC to perform the chamfering, especially perform the chamfering to unnecessary curved surfaces of the metal housing which is thinner in thickness, since unnecessary curved surfaces are uncertain after the curved surface forming of the metal housing. Furthermore, during the processing, the cutter is prone to oscillate since the material of the metal housing is thin, and thus the chamfered slanted surface is prone to be scratched. In this way, the quality of the chamfered slanted surface may be impacted.

SUMMARY

The technical problem which the present disclosure mainly solves is to provide a processing method and a processing apparatus for a metal housing, which is capable of solving the technical problems that the chamfer processing is difficult and the chamfered slanted surface is prone to be scratched when using CNC.

In order to solve the above technical problem, a technical scheme adopted by the present disclosure is to provide a processing method for a metal housing. The method includes: sleeving a metal flat pipe having an end face provided with a curved surface portion on a lower mold; and pressing the curved surface portion by the cooperation between an upper mold and the lower mold, thereby forming a chamfered slanted surface on the curved surface portion.

In order to solve the above technical problem, still another technical scheme adopted by the present disclosure is to provide a processing apparatus for a metal housing comprising: a lower mold, configured to fix a metal flat pipe having an end face provided with a curved surface portion; an upper mold, configured to cooperate with the lower mold to press the curved surface portion, in such a way that a chamfered slanted surface is formed on the end face of the metal flat pipe.

The present disclosure may achieve the following advantageous effects: different from the prior art, in the processing method and processing apparatus provided in the present disclosure, a metal flat pipe having a curved surface portion provided on an end face may be firstly sleeved on the lower mold, and then the curved surface portion may be pressed by the cooperation between the upper mold and the lower mold; in this way, a chamfered slanted surface may be formed on the curved surface portion. The processing processes and the apparatus involved are simple, the quality of the products is improved, and the method is suitable for mass production.

DETAILED DESCRIPTION

Some terms are used in the specification and claims to indicate specific components. However, one skilled in the art may understand that, manufacturers may use different terms to indicate the same components. In the specification and claims of the present disclosure, the components are distinguished from each other based on the functional differences, rather than the names used here. The present disclosure will now be described in detail in connection with the drawings and embodiments.

First Embodiment

Figure 1:
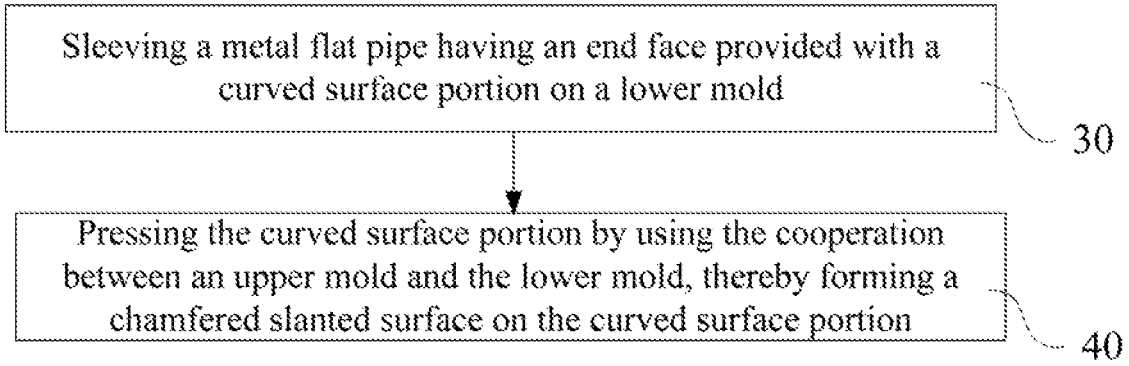
FIG. 1 is a flow chart of a first embodiment of a processing method for a metal housing of the present disclosure.

Referring to FIG. 1, a flow chart of a first embodiment of a processing method for a metal housing of the present disclosure is depicted. The processing method for a metal housing of the present embodiment may include the following blocks.

At block S30: a metal flat pipe having an end face provided with a curved surface portion may be sleeved on a lower mold.

At block S40: the curved surface portion may be pressed by the cooperation between an upper mold and the lower mold; in this way, a chamfered slanted surface may be formed on the curved surface portion.

In the chamfering method of the metal housing provided in the embodiment of the present disclosure, a metal flat pipe having an end face provided with a curved surface portion may be firstly sleeved on a lower mold; and then the curved surface portion may be pressed by the cooperation between an upper mold and a lower mold; in this way, a chamfered slanted surface may be formed on the curved surface portion. The processing processes and the apparatus involved in the method are simple, the quality of the products is improved, and thus the method may be suitable for mass production.

In this embodiment, the lower mold may include a first lower mold and a second lower mold. The upper mold may include a first upper mold and a second upper mold. The block S30 may specifically include: sleeving the curved surface portion of the metal flat pipe on an end face of the first lower mold that has a horn-shaped recess formed thereon; sleeving a first metal section on a first core section; sleeving a second metal section on a second core section, and sleeving a third metal section on a third core section. In this embodiment, the third metal section may be abutted against a fourth core section having a sectional width larger than that of the third core section, thereby preventing the metal flat pipe from sliding axially.

Figure 1A:
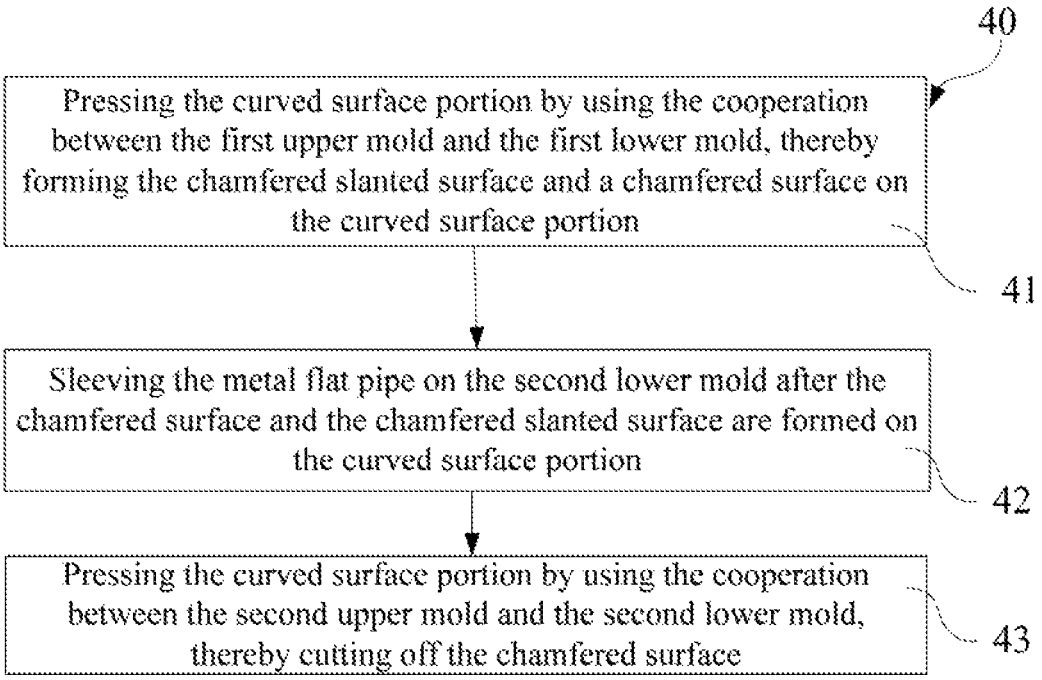
FIG. 1A is a flow chart showing parts of the processing method for a metal housing in FIG. 1.

Referring to FIG. 1A, a flow chart showing parts of the processing method for a metal housing in FIG. 1 is depicted. The block S40 may specifically include the following blocks.

At block S41: the curved surface portion may be pressed by the cooperation between the first upper mold and the first lower mold, and thus the chamfered slanted surface and a chamfered surface are formed on the curved surface portion.

That is to say, the curved surface portion may be pressed by the cooperation between a boss on an end face of the first upper mold that has a slanted surface and the horn-shaped recess provided on an end face of the first lower mold. In this way, the chamfered slanted surface and the chamfered surface may be formed on the curved surface portion. In specific, the end face of the first upper mold may be provided with an annular depression and a boss arranged in the annular depression, and an outer side of the boss is a slanted surface. The end face of the first lower mold may be provided with a horn-shaped recess. The boss of which the outer side is a slanted surface may cooperate with the horn-shaped recess in order to press the curved surface portion. In this way, the chamfered surface and the chamfered slanted surface connected to the chamfered surface may be formed in the inner side of the curved surface portion. The annular depression may be configured to maintain the outer shape of the curved surface portion.

At block S42: the metal flat pipe may be sleeved on the second lower mold after the chamfered surface and the chamfered slanted surface are formed on the curved surface portion.

In this embodiment, the block specifically includes: sleeving the curved surface portion of the metal flat pipe on an end face of the second lower mold; sleeving the first metal section on a first molding section; sleeving the second metal section on a second molding section, and sleeving the third metal section on a third molding section. In this embodiment, the second lower mold may have a through-hole formed therein. The third metal section may be abutted against the fourth molding section having a sectional width larger than that of the third molding section, thereby preventing the metal flat pipe from sliding axially.

At block S43: the curved surface portion may be pressed by the cooperation between the second upper mold and the second lower mold, and thus the chamfered surface may be cut off.

In this embodiment, the block S43 may specifically include: cutting off the chamfered surface by the cooperation between an annular cutting edge on the end face of the second upper mold and the through-hole of the second lower mold.

Second Embodiment

Figure 2:
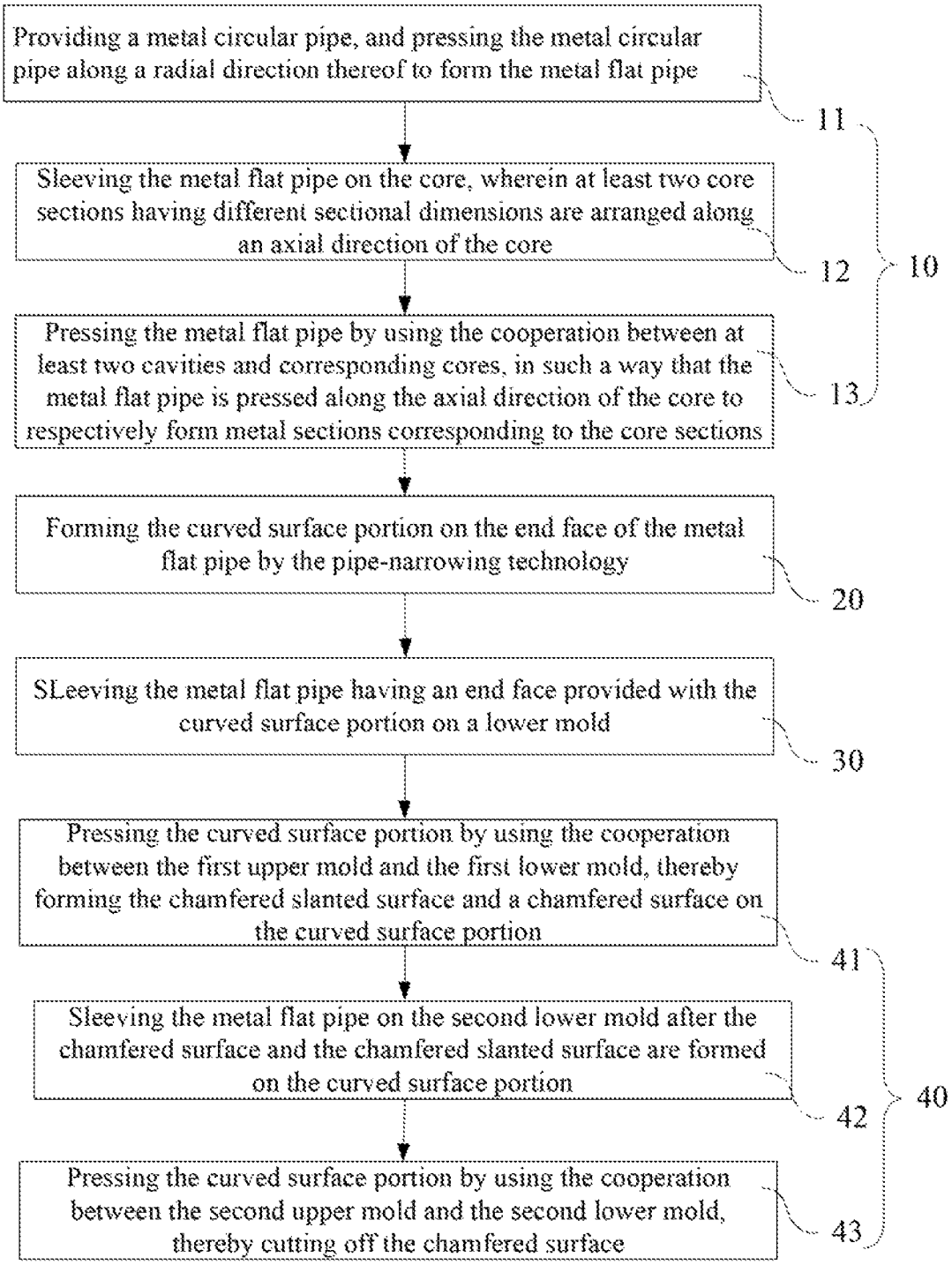
FIG. 2 is a flow chart of a second embodiment of a processing method for a metal housing of the present disclosure.

Referring to FIG. 2, a flow chart of a second embodiment of a processing method for a metal housing of the present disclosure is depicted. The method of the second embodiment is substantially the same as that of the first embodiment. The difference between these two embodiments may lie in that, the processing method for a metal housing of the second embodiment may further include the following blocks implemented before the block S30.

At block S10: the metal flat pipe may be formed by a circular pipe using pipe-expansion technology.

In this embodiment, the block S10 may specifically include the following blocks.

At block S11: a metal circular pipe may be provided, and the metal circular pipe may be pressed along a radial direction thereof to form the metal flat pipe.

A block S12: the metal flat pipe may be sleeved on the core, wherein at least two core sections having different sectional dimensions may be arranged along an axial direction of the core.

At block S13: the metal flat pipe may be pressed by the cooperation between at least two cavities and corresponding cores, in such a way that the metal flat pipe may be pressed along the axial direction of the core to respectively form metal sections corresponding to the core sections.

The block S13 may be achieved by at least one process selecting from a group consisting of the pipe-expansion process configured to enlarge the sectional dimension of the metal flat pipe, the pipe-narrowing process configured to reduce the sectional dimension of the metal flat pipe, and the pipe-expansion or pipe-narrowing shaping process configured to shape the expanded or narrowed metal flat pipe. In this way, the metal sections having different pipe diameters may be formed by the metal flat pipe.

At block S20: the curved surface portion may be formed on the end face of the metal flat pipe by the pipe-narrowing technology.

In this embodiment, the end face of the metal flat pipe may be pressed by the cooperation between the cavities and the cores, and thus the curved surface portion may be formed on the end face of the metal flat pipe.

Third Embodiment

Figure 3:
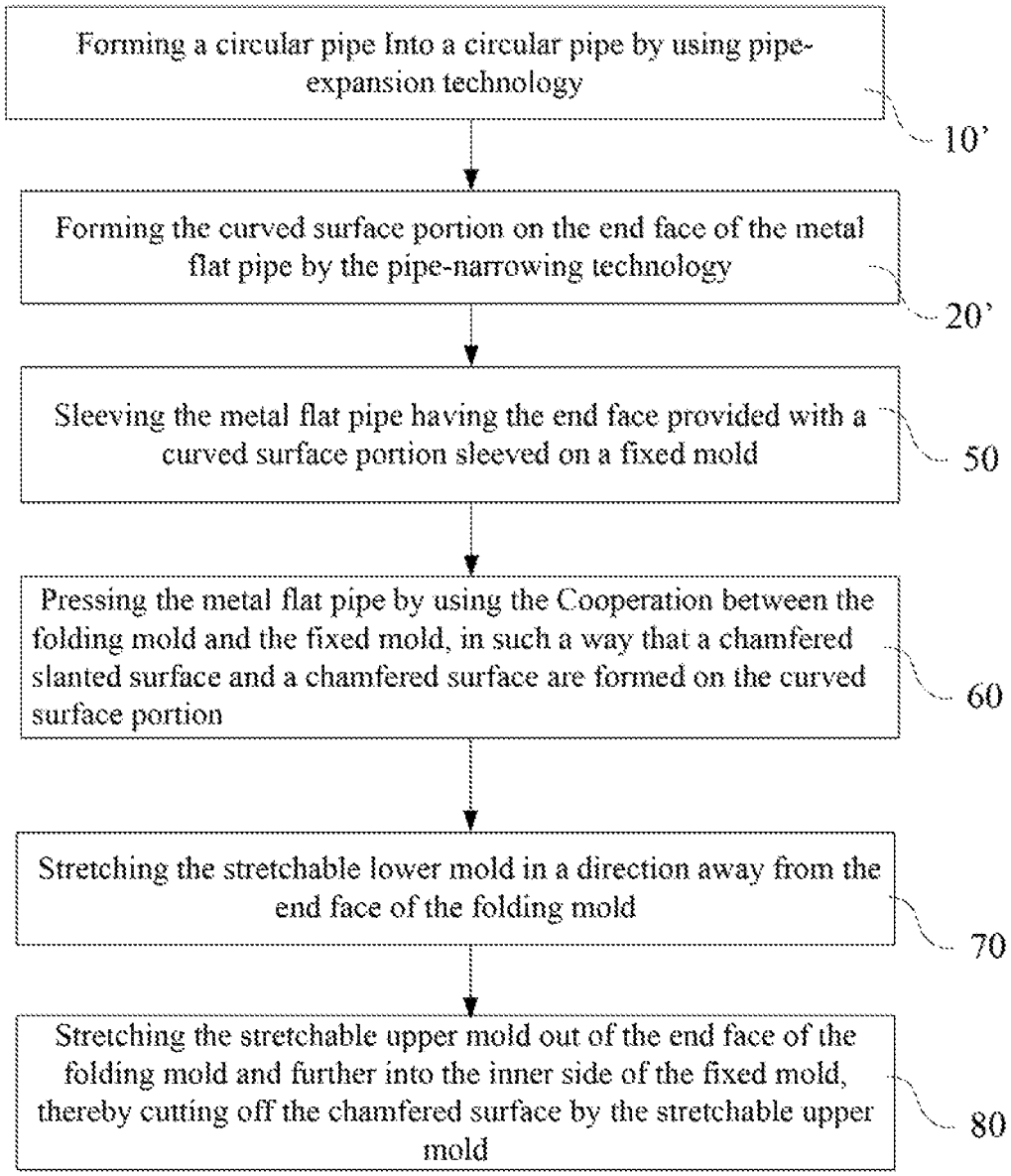
FIG. 3 is a flow chart of a third embodiment of a processing method for a metal housing of the present disclosure.

Referring to FIG. 3, a flow chart of a third embodiment of a processing method for a metal housing of the present disclosure is depicted. The processing method for a metal housing of the third embodiment may include the following blocks.

At block S10': the metal flat pipe may be formed by a circular pipe using pipe-expansion technology.

The block S10' is the same as the block S10 in the second embodiment.

At block S20': the curved surface portion may be formed on the end face of the metal flat pipe by the pipe-narrowing technology.

The block S20' is the same as the block S20 in the second embodiment.

At block S50: the metal flat pipe having the end face provided with a curved surface portion may be sleeved on a fixed mold.

In this embodiment, the lower mold may include a fixed mold and a stretchable lower mold, and the upper mold may include a folding mold and a stretchable upper mold. The fixed mold may be stretchably connected to the stretchable lower mold. When the stretchable lower mold is reset, the stretchable lower mold is retracted into the fixed mold, and thus a through-hole on an end face of the fixed mold is blocked and an opening groove is thereby formed. When the stretchable lower mold is stretched in a direction away from the end face of the fixed mold, the through-hole is formed in the fixed mold.

The block S50 may specifically include: sleeving the first metal section on a first core section of the fixed mold; sleeving the second metal section on a second core section of the fixed mold, sleeving the third metal section on a third core section of the fixed mold, and sleeving the curved surface portion of the metal flat pipe on an end face having a through-hole of the fixed mold. In this embodiment, the third metal section may be abutted against a fourth core section having a sectional width larger than that of the third core section, thereby preventing the metal flat pipe from sliding axially.

At block S60: the metal flat pipe may be pressed by the cooperation between the folding mold and the fixed mold, in such a way that a chamfered slanted surface and a chamfered surface may be formed on the curved surface portion.

In this embodiment, the folding mold may be stretchably connected to the stretchable upper mold. An annular depression may be formed on an end face of the folding mold, and a top cutting edge may be provided on an end face of the stretchable upper mold. When the stretchable upper mold is reset, the stretchable upper mold is retracted into the folding mold, and thus the end face of the stretchable upper mold may protrude out of the annular depression. When the stretchable upper mold is stretched out of the end face of the folding mold, the end face of the stretchable upper mold may stretch to the through-hole in the fixed mold. In this embodiment, the annular depression includes an outer ring curved surface, an inner ring slanted surface, and a concave surface formed between the outer ring curved surface and inner ring slanted surface.

The block S60 may specifically include: resetting the stretchable upper mold and the stretchable lower mold; protruding the end face of the stretchable upper mold out of the concave surface, and aligning the end face of the stretchable upper mold with an edge of the inner ring slanted surface; forming an opening groove by the stretchable lower mold and the fixed mold during the resetting of the stretchable lower mold; pressing the curved surface portion by the cooperation between the end face of the stretchable upper mold that protrudes out of the concave surface, thereby forming the chamfered slanted surface and the chamfered surface on the curved surface portion. In specific, when the curved surface portion is pressed by the cooperation between the annular slanted surface of the folding mold and the inner ring slanted surface of the folding mold, the chamfered slanted surface may be formed. When the curved surface portion is pressed by the cooperation between the end face of the stretchable upper mold and the opening groove formed by the stretchable lower mold, the chamfered surface may be formed.

At block S70: the stretchable lower mold may be stretched in a direction away from the end face of the folding mold.

In this embodiment, a through-hole may be formed in the fixed mold when the stretchable lower mold is stretched out of the fixed mold.

At block S80: the stretchable upper mold may be stretched out of the end face of the folding mold and further stretched into the inner side of the fixed mold, and thus the chamfered surface may be cut off by the stretchable upper mold.

In this embodiment, a top cutting edge configured to cut off the chamfered surface may be formed on the end portion of the stretchable upper mold. Accordingly, the block S80 may specifically include: stretching the stretchable upper mold of the end face of the folding mold and further into the through-hole of the fixed mold, thereby cutting off the chamfered surface by the top cutting edge.

Fourth Embodiment

Figure 4:
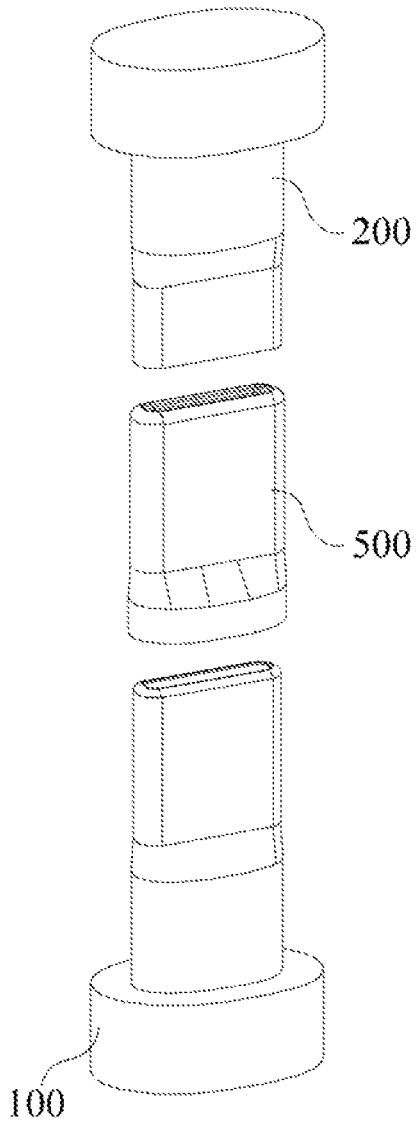
FIG. 4 is an exploded view of the first closing mold of a fourth embodiment of a processing apparatus for a metal housing of the present disclosure.
Figure 5:
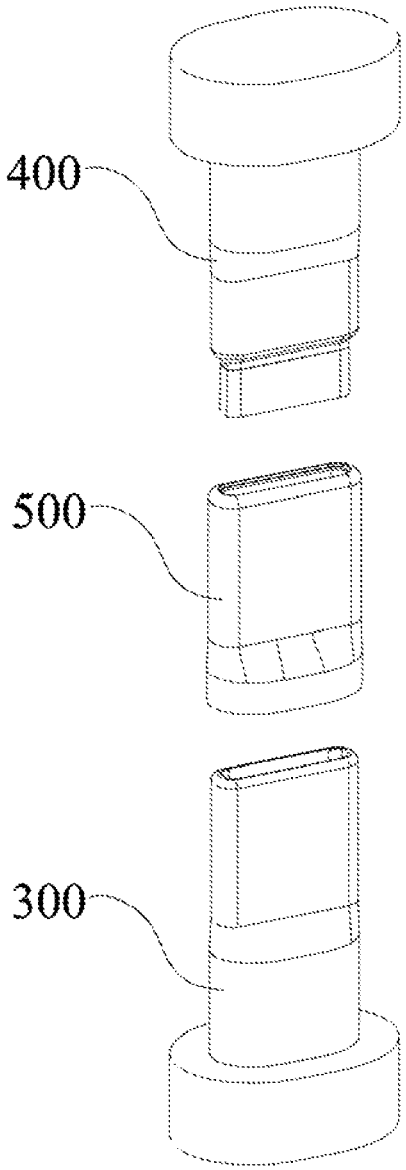
FIG. 5 is an exploded view of the second closing mold of a fourth embodiment of a processing apparatus for a metal housing of the present disclosure.

Referring to FIG. 4, an exploded view of the first closing mold of a fourth embodiment of a processing apparatus for a metal housing of the present disclosure is depicted. Referring to FIG. 5, an exploded view of the second closing mold of a fourth embodiment of a processing apparatus for a metal housing of the present disclosure is depicted.

The present disclosure further provides a processing apparatus for a metal housing. The apparatus may include a lower mold and an upper mold. The lower mold may be configured to fix the metal flat pipe having a curved surface portion on the end face. The curved surface portion may be pressed by the cooperation between the upper mold and the lower mold, in such a way that the chamfered slanted surface may be formed on the end face of the metal flat pipe. As is shown in FIG. 4 and FIG. 5, the lower mold of the present embodiment may include a first lower mold 100 and a second lower mold 300, and the upper mold may include a first upper mold 200 and a second upper mold 400. In this embodiment, the first lower mold 100 and the first upper mold 200 together forms a first closing mold, and the second lower mold 300 and the second upper mold 400 together forms a second closing mold.

Figure 6:
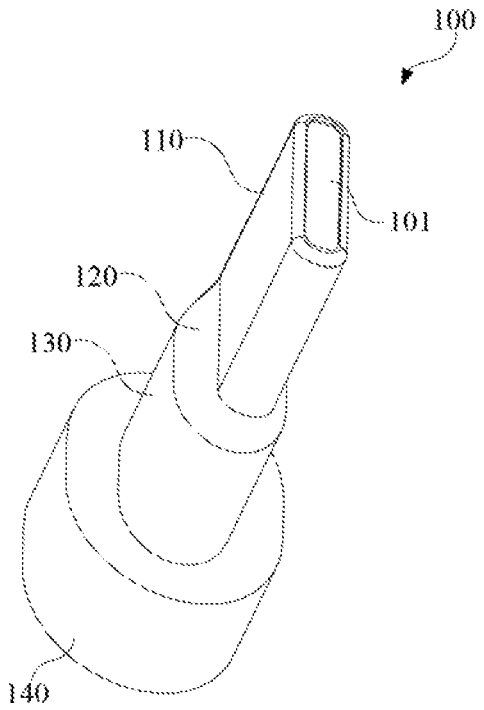
FIG. 6 is a stereogram of a first lower mold of the processing apparatus for a metal housing shown in FIG. 4.

Referring to FIG. 6, a stereogram of a first lower mold of the processing apparatus for a metal housing shown in FIG. 4 is depicted. The first lower mold 100 may include an end face having a horn-shaped recess 101, a first core section 110, a second core section 120, a third core section 130 and a fourth core section 140 which are subsequently connected with one another. The end face is connected to the first core section 110.

Figure 7:
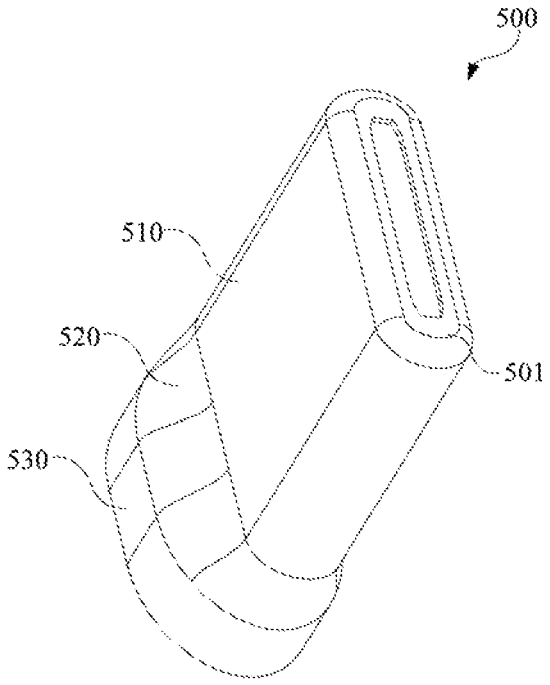
FIG. 7 is a stereogram of a metal flat pipe to be processed of the present disclosure.

Referring to FIG. 7, a stereogram of a metal flat pipe to be processed of the present disclosure is depicted. The metal flat pipe 500 may include a first metal section 510, a second metal section 520 and a third metal section 530. The first metal section 510 may be sleeved on the first core section 110, the second metal section 520 may be sleeved on the second core section 120, and the third metal section 530 may be sleeved on the third core section 130. A curved surface portion 501 may be sleeved on the end face having a horn-shaped recess 101. The third metal section 530 may be abutted against the fourth core section 140 having a sectional width larger than that of the third core section 130, thereby preventing the metal flat pipe 500 from sliding axially. It should be noted that, the sectional widths respectively of the metal sections each are different from each other. In specific, a sectional width of the first metal section 510 is smaller than that of the second metal section 520, and the sectional width of the second metal section 520 is smaller than that of the third metal section 530. The sectional width of the second metal section 520 is reduced gradually in a direction towards the first metal section. Of course, in other embodiments, the sectional widths respectively of the metal sections each may be varied irregularly, and the sectional widths will not be specifically limited in the present disclosure. However, an inner wall of each of the metal sections should be adhered to an outer wall of the corresponding core sections of the first lower mold 100.

Figure 8:
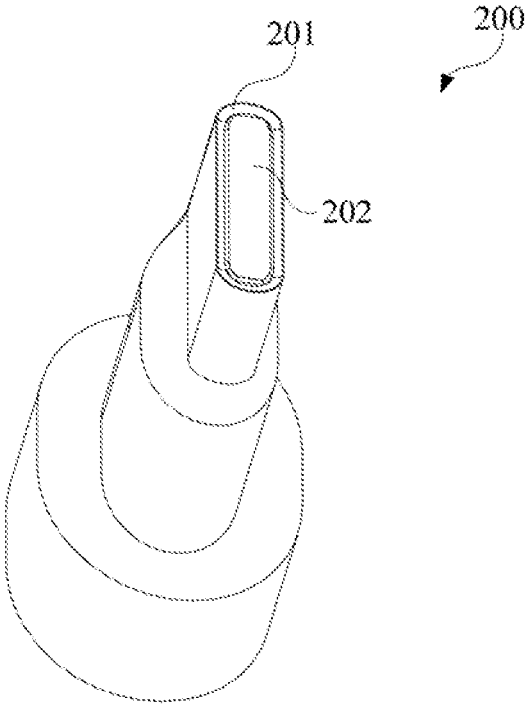
FIG. 8 is a stereogram of a first upper mold of the processing apparatus for a metal housing shown in FIG. 4.
Figure 9:
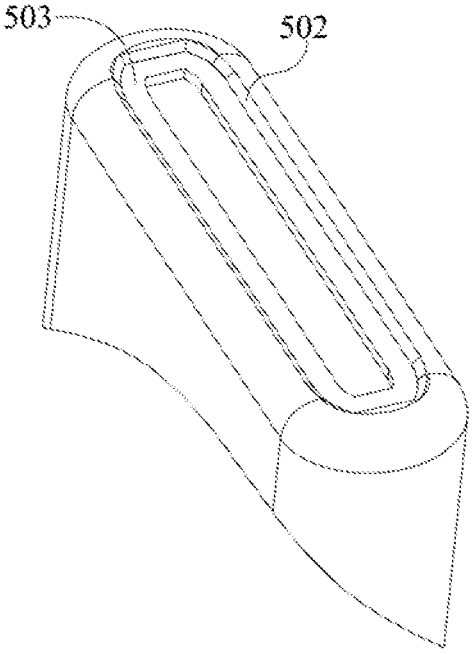
FIG. 9 is a partial view of the metal flat pipe after being processed by the first closing mold of the processing apparatus for a metal housing shown in FIG. 4.

Referring to FIG. 8 and FIG. 9, in FIG. 8, a stereogram of a first upper mold of the processing apparatus for a metal housing shown in FIG. 4 is depicted; in FIG. 9, a partial view of the metal flat pipe after being processed by the first closing mold of the processing apparatus for a metal housing shown in FIG. 4 is depicted. The end face of the first upper mold 200 may be provided with an annular depression 201 and a boss 202 arranged in the annular depression 201, and the outer side of the boss 202 may be a slanted surface. In this embodiment, an outer ring edge of the annular depression 201 may be at a level higher than an inner ring edge thereof. The inner ring edge may be integrated with the slanted boss 202, in such a way that the annular depression 201 having a certain height is formed between the outer ring edge and the inner ring edge. As is shown in FIG. 9, the curved surface portion 501 is pressed by the cooperation between the boss 202 and the horn-shaped recess 101, and thus a chamfered surface 503 and a chamfered slanted surface 502 subsequently connected with one another may be formed in the inner side of the curved surface portion 501. The annular depression 201 helps to maintain the outer shape of the curved surface portion 501.

The first lower mold 100 is configured to fix the metal flat pipe 500 having an end face provided with a curved surface portion 501. The curved surface portion 501 may be pressed by the cooperation between the first upper mold 200 and the first lower mold 100, and the chamfered slanted surface 502 and the chamfered surface 503 as is shown in FIG. 9 may be formed on the end face of the metal flat pipe 500. The second lower mold 300 may be configured to fix the metal flat pipe 500 having the chamfered slanted surface 502 and the chamfered surface 503. The second upper mold 400 cooperates with the second lower mold 300 in order to cut off the chamfered surface 503.

Figure 10:
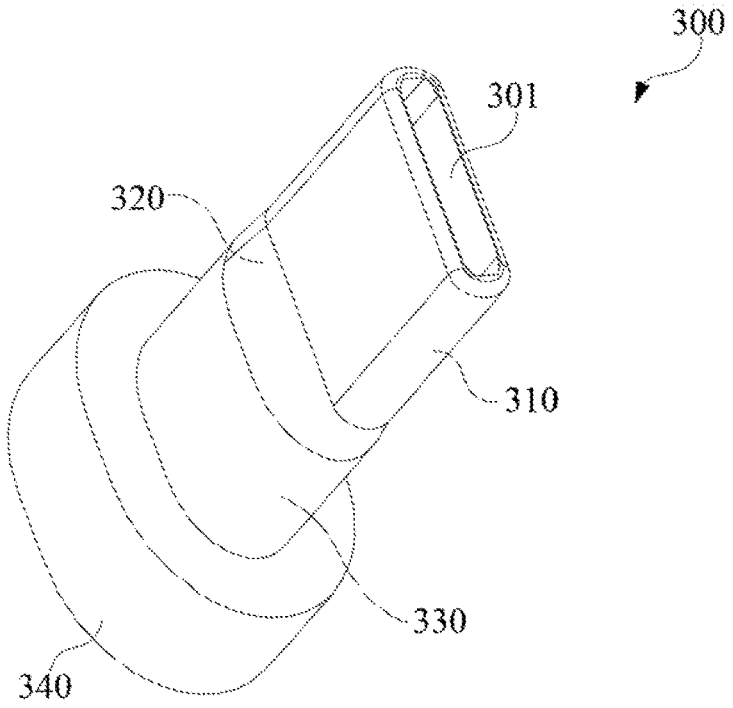
FIG. 10 is a stereogram of a second lower mold of the processing apparatus for a metal housing shown in FIG. 5.

Referring to FIG. 10, a stereogram of a second lower mold of the processing apparatus for a metal housing shown in FIG. 5 is depicted. The second lower mold 300 may include a first molding section 310, a second molding section 320, a third molding section 330 and a fourth molding section 340 which are subsequently connected with one another and which respectively have a through-hole 301. The first metal section 510 may be sleeved on the first molding section 310, the second metal section 520 may be sleeved on the second molding section 320, the third metal section 530 may be sleeved on the third molding section 330, and the curved surface portion 501 having the chamfered slanted surface 502 and the chamfered surface 503 provided thereon may be sleeved on an end face of the second lower mold 300. The third metal section 530 may be abutted against the fourth molding section 340 having a sectional width larger than that of the third molding section 330, thereby preventing the metal flat pipe 500 from sliding axially.

Figure 11:
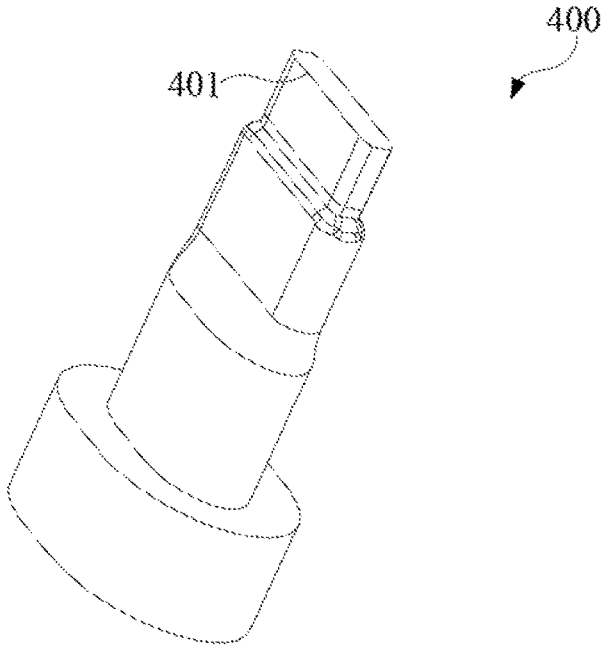
FIG. 11 is a stereogram of a second upper mold of the processing apparatus for a metal housing shown in FIG. 5.

Referring to FIG. 11, a stereogram of a second upper mold of the processing apparatus for a metal housing shown in FIG. 5 is depicted. An annular cutting edge 401 is formed on the end face of the second upper mold 400. The annular cutting edge 401 cooperates with the through-hole 301 of the second lower mold 300 in order to cut off the chamfered surface 503.

Fifth Embodiment

Figure 12:
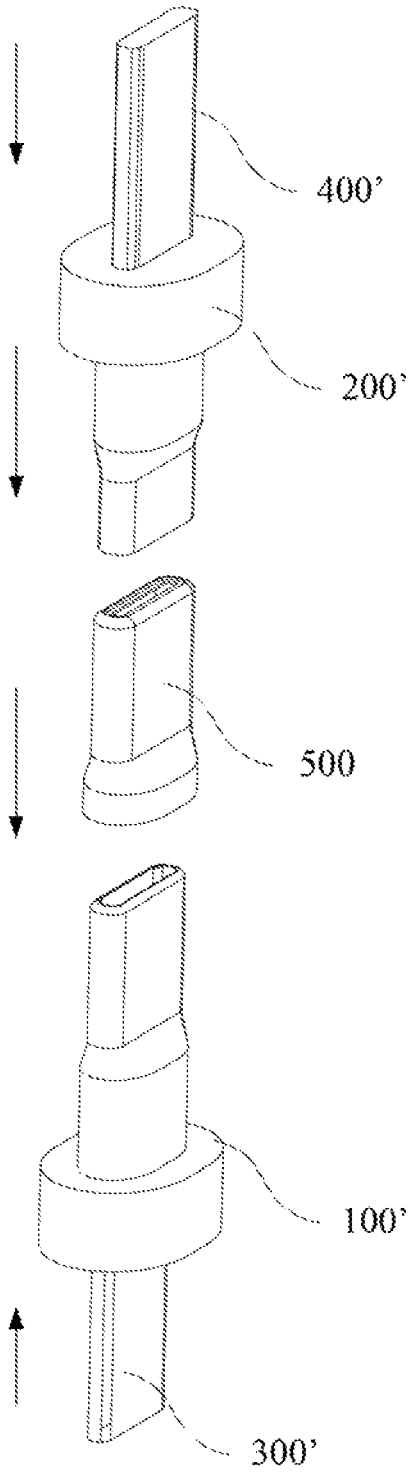
FIG. 12 is an exploded view of a fifth embodiment of a processing apparatus for a metal housing of the present disclosure.

Referring to FIG. 12, an exploded view of a fifth embodiment of a processing apparatus for a metal housing of the present disclosure is depicted.

The processing apparatus for a metal housing of the fifth embodiment is substantially the same as that of the fourth embodiment. The difference between these two embodiments lies in that, the processing apparatus for a metal housing in the fifth embodiment does not include the second upper mold 300 and the second lower mold 400; instead, a stretchable lower mold 300' is arranged in the fixed mold 100', and a stretchable upper mold 400 is arranged in the folding mold 200' in this embodiment. In specific, as is shown in FIG. 12, the lower mold of the processing apparatus for a metal housing of the fifth embodiment may include a fixed mold 100' and a stretchable lower mold 300', and the upper mold may include a folding mold 200' and a stretchable upper mold 400'. The stretchable upper mold 400' may be stretchably connected to the folding mold 200' via a cylinder and the stretchable lower mold 300' may be stretchably connected to the fixed mold 100' via a cylinder. Of course, in other embodiment, it is also possible to stretchably connect the fixed mold 100' to the stretchable lower mold 300' and stretchably connect the folding mold 200' to the stretchable upper mold 400' via any other suitable driving device, such as a hydraulic cylinder and the like. When the fixed mold 100' and the stretchable lower mold 300' are reset, the end face of the fixed mold 100' matching with the stretchable lower mold 300' is in the same shape as the end face of the first lower mold 100 of the fourth embodiment. When the folding mold 200' and the stretchable upper mold 400' are reset, the end face of the folding mold 200' matching with the stretchable upper mold 400' is in the same shape as the end face of the first upper mold of the fourth embodiment.

Figure 13:
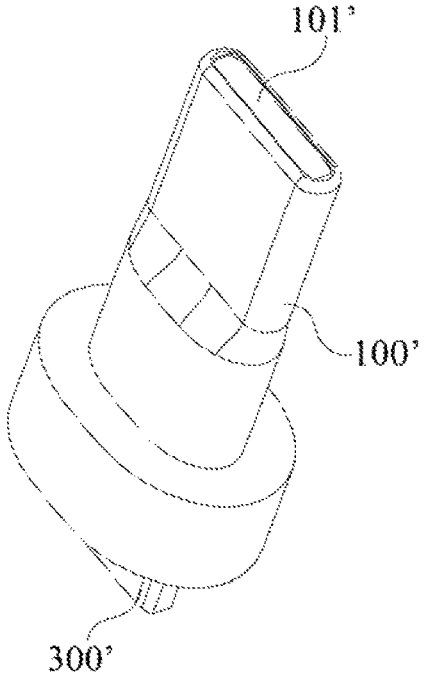
FIG. 13 is a schematic view showing the stretchable lower mold of the processing apparatus for a metal housing shown in FIG. 12, wherein the stretchable lower mold is reset.
Figure 13A:
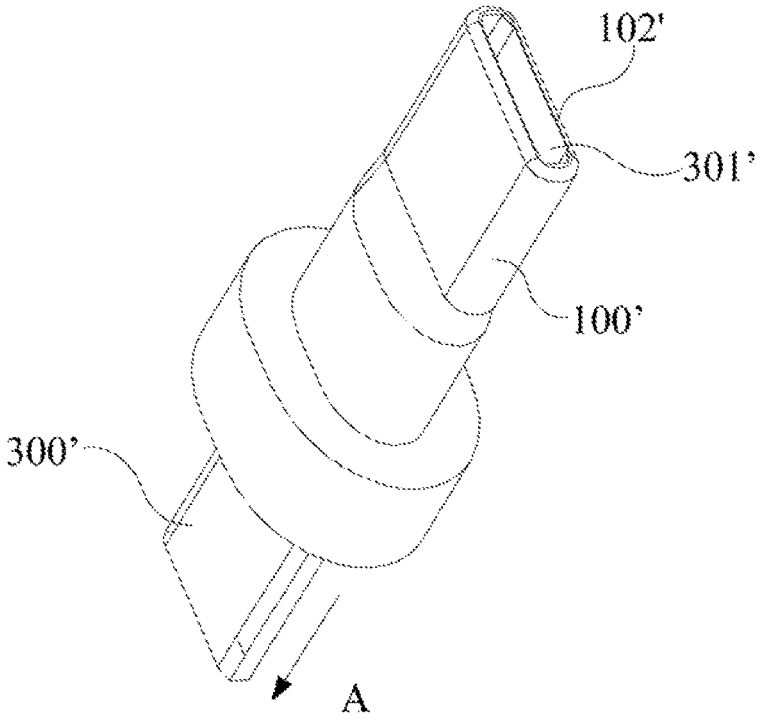
FIG. 13A is a schematic view showing the stretchable lower mold of the processing apparatus for a metal housing shown in FIG. 12, wherein the stretchable lower mold is stretched out.

Referring to FIGS. 13 and 13A, in FIG. 13, a schematic view showing the stretchable lower mold of the processing apparatus for a metal housing shown in FIG. 12 is depicted, wherein the stretchable lower mold is reset. In FIG. 13A, a schematic view showing the stretchable lower mold of the processing apparatus for a metal housing shown in FIG. 12 is depicted, wherein the stretchable lower mold is stretched out. The fixed mold 100' of the present embodiment is in the same shape as the first lower mold 100 of the fourth embodiment of the processing apparatus for a metal housing. The difference between these two embodiments lies in that, a through-hole 301' passing through the end face may be further formed in the fixed mold 100' of the present embodiment. The edge of the through-hole 301' may be an annular slanted surface 102'. When the stretchable lower mold 300' is reset and retracted back into the fixed mold 100', the through-hole 301' may be blocked, and thus the annular slanted surface 102' and the end face of the stretchable lower mold 300' together form an opening groove 101'. As is shown in FIG. 13A, when the stretchable lower mold 300' is stretched along the direction A, the stretchable lower mold 300' is moved away from the end face of the fixed mold 100', and thus the through-hole 301' passing through the end face may be formed in the fixed mold 100'.

Figure 14:
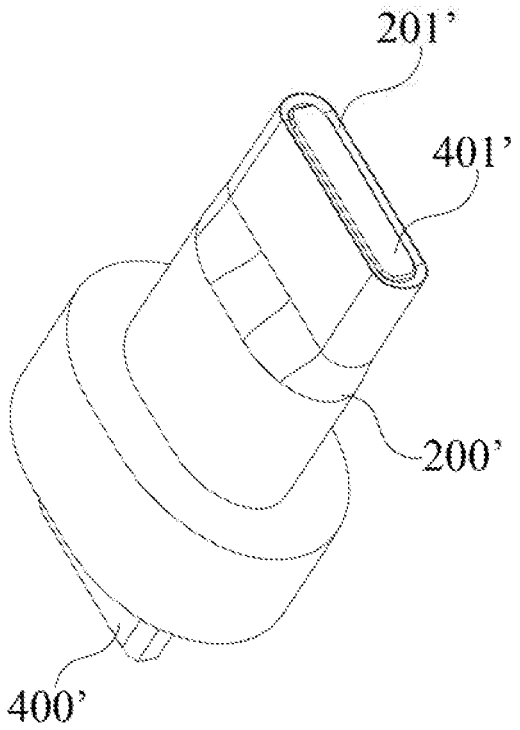
FIG. 14 is a schematic view showing the stretchable upper mold of the processing apparatus for a metal housing shown in FIG. 12, wherein the stretchable upper mold is reset.
Figure 14A:
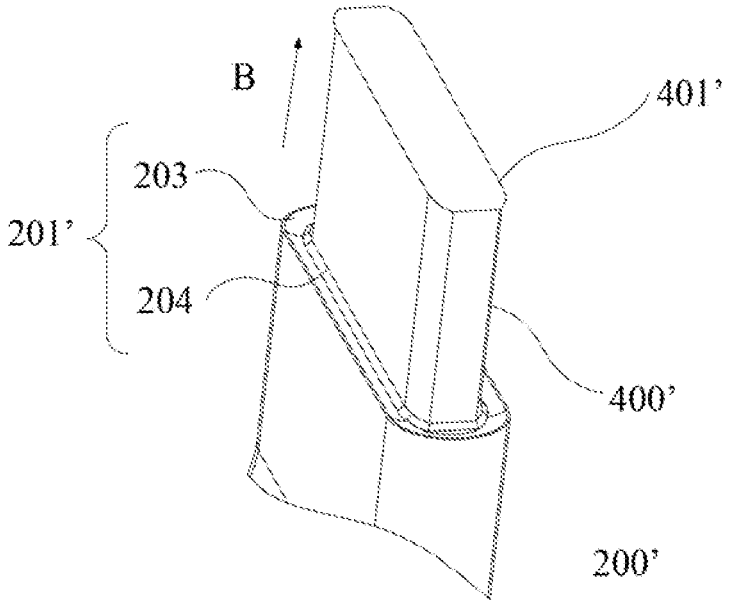
FIG. 14A is a schematic view showing the stretchable upper mold of the processing apparatus for a metal housing shown in FIG. 12, wherein the stretchable upper mold is stretched out.

Referring to FIGS. 14 and 14A, in FIG. 14, a schematic view showing the stretchable upper mold of the processing apparatus for a metal housing shown in FIG. 12 is depicted, wherein the stretchable upper mold is reset. In FIG. 14A, a schematic view showing the stretchable upper mold of the processing apparatus for a metal housing shown in FIG. 12 is depicted, wherein the stretchable upper mold is stretched out. The folding mold 200' of the present embodiment is in the same shape as the first upper mold 200 of the fourth embodiment of the processing apparatus for a metal housing. The difference between these two embodiments lies in that, a through-hole passing through the end face is further formed in the folding mold 200' of the present embodiment. In this embodiment, the end face of the folding mold 200' may have an annular depression 201' formed thereon, wherein the annular depression 201' may include an outer ring curved surface 203, an inner ring slanted surface 204, and a concave surface formed between the outer ring curved surface 203 and inner ring slanted surface 204. A top cutting edge may be formed on the end face 401' of the stretchable upper mold 400'. When the stretchable upper mold 400' is reset, the stretchable upper mold 400' may be retracted into the folding mold 200', and thus the end face 401' of the stretchable upper mold 400' may be protruded out of the concave surface and further aligned with the inner ring slanted surface 204. When the stretchable upper mold 400' is stretched out of the end face of the folding mold 200', the end face 401' of the stretchable upper mold 400' may be stretched into the inner side of the fixed mold 100'.

When the stretchable upper mold 400' is reset, the end face 401' of the stretchable upper mold 400' may be protruded out of the annular depression 201'. In specific, the end face 401' of the stretchable upper mold 400' may be protruded out of the concave surface, and further aligned with the inner ring slanted surface 204. When the stretchable lower mold 300' is reset, the stretchable lower mold 300' and the fixed mold 100' may together form an opening groove 101'. The opening groove 101' may be pressed by the end face 401' aligned with the inner ring slanted surface 204, and thus the chamfered slanted surface 502 and the chamfered surface 503 as is shown in FIG. 9 may be formed on the curved surface portion 501. In specific, when the curved surface portion 501 is pressed by the cooperation between the annular slanted surface 102' of the fixed mold 100' and the inner ring slanted surface 204 of the folding mold 200', the chamfered slanted surface 502 may be formed. When the curved surface portion 501 is pressed by the cooperation between the end face of the stretchable upper mold 400' and the opening groove 101' formed by the stretchable lower mold 300', the chamfered surface 503 may be formed.

Figure 15:
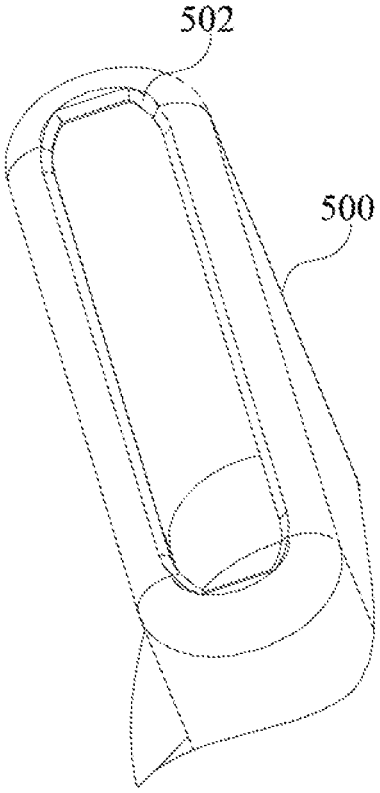
FIG. 15 is a partial view of the metal flat pipe after being processed by the processing apparatus for a metal housing of the present disclosure.

As is shown in FIG. 13A, the stretchable lower mold 300' may be stretched in a direction away from the end face of the fixed mold 100' along the direction A, and thus the through-hole 301' may be formed in the fixed mold 100'. As is shown in FIG. 14A, the stretchable upper mold 400' may be stretched out of the end face of the folding mold 200' along a direction B, and further stretched to the through-hole 301' of the fixed mold 100'. In this way, the top cutting edge may cut off the chamfered surface 503, and thus the end face of the metal flat pipe 500 only has the chamfered slanted surface 502 (as is shown in FIG. 15) formed thereon.

It should be noted that, slopes respectively of the annular slanted surface 102', the inner ring slanted surface 204, and the slanted surface on the outer side of the boss 202 may be selected based on the required dimension of the chamfer of the metal flat pipe. In the present disclosure, a thickness of the metal flat pipe 500 to be processed may be optionally 0.15 mm, and the dimension of the chamfer formed on the curved surface portion 501 of the processed metal flat pipe 500 may be optionally 45 degrees×0.1 mm. Of course, in other embodiments, any suitable thickness and dimension of the chamfer of the metal flat pipe may be selected. For example, the thickness of the metal flat pipe 500 may be 0.1 mm, and the dimension of the chamfer may be 30 degrees× 0.06 mm.

In other embodiment, the processing apparatus for a metal housing may further include a pipe-expansion mechanism and a pipe-narrowing mechanism. The pipe-expansion mechanism may be configured to process the circular pipe into the metal flat pipe 500. The pipe-narrowing mechanism may be configured to form the curved surface portion 501 on the end face of the metal flat pipe 500.

The pipe-expansion mechanism and the pipe-narrowing mechanism may respectively include at least two cavities and two cores. The metal flat pipe 500 may be pressed by the cooperation between the cavities and the cores in order to form the metal sections having different pipe diameters. In specific, the pipe-expansion mechanism and the pipe-narrowing mechanism may use at least one process selecting from a group consisting of the pipe-expansion process configured to enlarge the sectional dimension of the metal flat pipe, the pipe-narrowing process configured to reduce the sectional dimension of the metal flat pipe, and the pipe-expansion or pipe-narrowing shaping process configured to shape the expanded or narrowed metal flat pipe. In this way, the metal sections having different pipe diameters may be formed by the metal flat pipe 500.

The pipe-narrowing mechanism may use the cooperation between the cavities and the cores to press the end face of the metal flat pipe 500, and thus the curved surface portion 501 may be formed on the end face of the metal flat pipe 500.

The metal flat pipe 500 of the present disclosure may be applied as a data interface of an USB (Universal Serial Bus). The metal flat pipe 500 used as the USB data interface may certainly be applied as the data line of other types. And it will not be specifically limited here.

The present disclosure may achieve the following advantageous effects: different from the prior art, in the processing method and processing apparatus provided in the present disclosure, a metal flat pipe having a curved surface portion provided on an end face may be firstly sleeved on the lower mold, and then the curved surface portion may be pressed by the cooperation between the upper mold and the lower mold; in this way, a chamfered slanted surface may be formed on the curved surface portion. The processing processes and the apparatus involved are simple, the quality of the products is improved, and the method is suitable for mass production.

The foregoing is merely embodiments of the present disclosure, and is not intended to limit the scope of the present disclosure. Any equivalent structure or flow transformation made based on the specification and the accompanying drawings of the present disclosure, or any direct or indirect applications of the disclosure on other related fields, shall all be covered within the protection of the present disclosure.

What is claimed is:

1. A processing method for a metal housing, comprising:

sleeving a metal flat pipe having an end face provided with a curved surface portion on a lower mold; and pressing the curved surface portion by the cooperation between an upper mold and the lower mold, thereby forming a chamfered slanted surface on the curved surface portion;

wherein the lower mold includes a first lower mold and a second lower mold, and the upper mold includes a first upper mold and a second upper mold;

the sleeving a metal flat pipe having an end face provided with a curved surface portion on a lower mold comprises:

sleeving the curved surface portion of the metal flat pipe on an end face of the first lower mold that has a recess formed thereon; sleeving a first metal section on a first core section; sleeving a second metal section on a second core section, and sleeving a third metal section on a third core section; wherein the third metal section is abutted against a fourth core section having a sectional width larger than that of the third core section, thereby preventing the metal flat pipe from sliding axially.

2. The method of claim 1, wherein the pressing the curved surface portion by the cooperation between an upper mold and the lower mold, thereby forming a chamfered slanted surface on the curved surface portion includes:

pressing the curved surface portion by the cooperation between the first upper mold and the first lower mold, thereby forming the chamfered slanted surface and a chamfered surface on the curved surface portion;

sleeving the metal flat pipe on the second lower mold after the chamfered surface and the chamfered slanted surface are formed on the curved surface portion;

pressing the curved surface portion by the cooperation between the second upper mold and the second lower mold, thereby cutting off the chamfered surface.

3. The method of claim 2, wherein the pressing the curved surface portion by the cooperation between the first upper mold and the first lower mold, thereby forming the chamfered slanted surface and a chamfered surface on the curved surface portion includes:

pressing the curved surface portion by the cooperation between a boss on an end face of the first upper mold that has a slanted surface and the recess provided on an end face of the first lower mold, thereby forming the chamfered slanted surface and the chamfered surface on the curved surface portion.

4. The method of claim 3, wherein the pressing the curved surface portion by the cooperation between the second upper mold and the second lower mold, thereby cutting off the chamfered surface includes:

pressing the curved surface portion by the cooperation between an annular cutting edge on an end face of the second upper mold and a through-hole of the second lower mold, thereby cutting off the chamfered surface.

5. The method of claim 1, wherein the sleeving the metal flat pipe on the second lower mold after the chamfered surface and the chamfered slanted surface are formed on the curved surface portion includes:

sleeving the curved surface portion on an end face of the second lower mold having a through-hole; sleeving the first metal section on a first molding section; sleeving the second metal section on a second molding section, and sleeving the third metal section on a third molding section; the third metal section is abutted against a fourth molding section having a sectional width larger than that of the third molding section, thereby preventing the metal flat pipe from sliding axially.

6. The method of claim 1, wherein the lower mold includes a fixed mold and a stretchable lower mold, and the upper mold includes a folding mold and a stretchable upper mold;

the pressing the curved surface portion by the cooperation between an upper mold and the lower mold, thereby forming a chamfered slanted surface on the curved surface portion includes: pressing the metal flat pipe by the cooperation between the folding mold and the fixed mold, thereby forming the chamfered slanted surface and a chamfered surface on the curved surface portion;

stretching the stretchable lower mold in a direction away from an end face of the folding mold;

stretching the stretchable upper mold out of the end face of the folding mold and further into an inner side of the fixed mold, thereby cutting off the chamfered surface by the stretchable upper mold.

7. The method of claim 6, wherein the pressing the metal flat pipe by the cooperation between the folding mold and the fixed mold, thereby forming the chamfered slanted surface and a chamfered surface on the curved surface portion includes:

pressing the curved surface portion by the cooperation between an annular slanted surface of the fixed mold and an annular depression of the folding mold, thereby forming the chamfered slanted surface on the curved surface portion; and pressing the curved surface portion by the cooperation between an end face of the stretchable upper mold and an opening groove formed by the stretchable lower mold, thereby forming the chamfered surface.

8. The method of claim 1, further comprising the following steps implemented before the sleeving a metal flat pipe having an end face provided with a curved surface portion on a lower mold:

forming the metal flat pipe by a circular pipe using a pipe-expansion technology;

forming the curved surface portion on the end face of the metal flat pipe by a pipe-narrowing technology.

9. A processing apparatus for a metal housing, comprising:

a lower mold, configured to fix a metal flat pipe having an end face provided with a curved surface portion; and an upper mold, configured to cooperate with the lower mold to press the curved surface portion, in such a way that a chamfered slanted surface is formed on the end face of the metal flat pipe;

wherein the lower mold includes a first lower mold and a second lower mold, and the upper mold includes a first upper mold and a second upper mold;

wherein the first lower mold includes a first core section, a second core section, a third core section and a fourth core section which are subsequently connected with one another;

the metal flat pipe includes a first metal section, a second metal section and a third metal section which are subsequently connected with one another;

wherein the first metal section is sleeved on the first core section, the second metal section is sleeved on the second core section, and the third metal section is sleeved on the third core section; the curved surface portion is sleeved on the end face having a recess; the third metal section is abutted against the fourth core section having a sectional width larger than that of the third core section, thereby preventing the metal flat pipe from sliding axially.

10. The processing apparatus for a metal housing of claim 9, wherein the first lower mold is configured to fix the metal flat pipe having the end face provided with the curved surface portion;

the first upper mold is configured to cooperate with the first lower mold to press the curved surface portion, in such a way that the chamfered slanted surface and a chamfered surface are formed on the curved surface portion;

the second lower mold is configured to fix the metal flat pipe after the chamfered slanted surface and the chamfered surface are formed on the curved surface portion; and the second upper mold is configured to cooperate with the second lower mold to press the curved surface portion, thereby cutting off the chamfered surface.

11. The processing apparatus for a metal housing of claim 10, wherein an end face of the first upper mold is provided with an annular depression and a boss arranged in the annular depression;

the first lower mold includes an and face having the recess; wherein an outer side of the boss has a slanted surface;

the boss cooperates with the recess to press the curved surface portion, thereby forming the chamfered slanted surface and the chamfered surface on the curved surface portion.

12. The processing apparatus for a metal housing of claim 11, wherein an annular cutting edge is formed on an end face of the second upper mold, and the annular cutting edge cooperates with a through-hole of the second lower mold to press the curved surface portion, thereby cutting off the chamfered surface.

13. The processing apparatus for a metal housing of claim 9, wherein the second lower mold includes a first molding section, a second molding section, a third molding section and a fourth molding section which are subsequently connected with one another and which respectively have a through-hole;

the first metal section is sleeved on the first molding section, the second metal section is sleeved on the second molding section, and the third metal section is sleeved on the third molding section;

the curved surface portion is sleeved on an end face of the second lower mold; the third metal section is abutted against the fourth molding section having a sectional width larger than that of the third molding section, thereby preventing the metal flat pipe from sliding axially.

14. The processing apparatus for a metal housing of claim 9, wherein the lower mold includes a fixed mold and a stretchable lower mold, and the upper mold includes a folding mold and a stretchable upper mold;

the fixed mold is configured to fix the metal flat pipe having the end face provided with the curved surface portion;

the stretchable lower mold is configured to stretchably connect to the fixed mold;

the fold mold is configured to cooperate with the fixed mold to press the curved surface portion, in such a way that the chamfered slanted surface and a chamfered surface are formed on the curved surface portion;

the stretchable upper mold is configured to stretchably connect to folding mold; wherein the stretchable upper mold is stretched out of the end face of the folding mold and further stretched into an inner side of the fixing mold, thereby cutting off the chamfered surface via the stretchable upper mold.

15. The processing apparatus for a metal housing of claim 14, wherein an end face of the fixed mold includes an annular slanted surface;

when the fixed mold and the stretchable lower mold are reset, the annular slanted surface and the end face of the stretchable lower mold together form an opening groove; when the stretchable lower mold are stretched out, a through-hole is formed in the inner side of the fixed mold;

the end face of the folding mold has an annular depression formed thereon; the annular depression includes an outer ring curved surface, an inner ring slanted surface, and a concave surface formed between the outer ring curved surface and inner ring slanted surface; a top cutting edge is formed on an end face of the stretchable upper mold;

when the folding mold and the stretchable upper mold are reset, an edge of the inner ring slanted surface is aligned with the stretchable upper mold;

wherein the annular slanted surface of the fixed mold cooperates with the inner ring slanted surface of the folding mold to press the curved surface portion, thereby forming the chamfered slanted surface; the end face of the stretchable upper mold cooperates with the opening groove formed by the stretchable lower mold press the curved surface portion, thereby forming the chamfered surface.

16. The processing apparatus for a metal housing of claim 9, wherein a thickness of the metal flat pipe is 0.15 mm.

17. The processing apparatus for a metal housing of claim 16, wherein the dimension of the slanted surface of the chamfer is 45 degrees×0.1 mm.

18. The processing apparatus for a metal housing of claim 9, further comprising:

a pipe-expansion mechanism, configured to process the circular pipe into the metal flat pipe; and a pipe-narrowing mechanism, configured to form the curved surface portion on the end face of the metal flat pipe.

* * * * *